US006269747B1

(12) United States Patent
Strandli et al.

(10) Patent No.: US 6,269,747 B1
(45) Date of Patent: Aug. 7, 2001

(54) TRAINING ROCKET FOR SMOKE DEVELOPMENT

(75) Inventors: Kåre R. Strandli, Tønsberg; Johans Hamarsnes, Raufoss, both of (NO)

(73) Assignee: Nammo Raufoss AS, Raufoss (NO)

( * ) Notice: Subject to any disclaimer, the term of this patent is extended or adjusted under 35 U.S.C. 154(b) by 0 days.

(21) Appl. No.: 09/375,441

(22) Filed: Aug. 17, 1999

(30) Foreign Application Priority Data

Aug. 17, 1998 (NO) ..... 983762

(51) Int. Cl.[7] ..... F42B 12/48

(52) U.S. Cl. ..... 102/334; 102/347; 102/498; 102/513

(58) Field of Search ..... 102/334, 347, 102/374, 379, 395, 498, 513, 529

(56) References Cited

U.S. PATENT DOCUMENTS 3,361,066 * 1/1968 Gawlick et al. ..... 102/513
3,633,512 * 1/1972 Schlack ..... 102/513
3,855,930 * 12/1974 Mulich et al. ..... 102/334
3,981,241 * 9/1976 Ambrosini et al. ..... 102/334
4,353,301 * 10/1982 Jacobsen ..... 102/334
4,643,098 * 2/1987 Gudbrandsen et al. ..... 102/513
5,565,649 * 10/1996 Tougeron et al. ..... 102/513

FOREIGN PATENT DOCUMENTS

1090076 * 11/1967 (GB) ..... 102/334

* cited by examiner

*Primary Examiner*—Harold J. Tudor
(74) *Attorney, Agent, or Firm*—Bacon & Thomas, PLLC

(57) ABSTRACT

A training rocket for smoke development. The training rocket includes a rocket tube which contains powder and constitutes a propulsion motor for the rocket. The rocket includes a forward training head which contains a smoke composition adapted to emit visible smoke upon impact. An igniter charge, such as a tracer charge, which can be ignited by the propellant powder is situated in the rearmost of the training head, behind a bursting charge which can be ignited by the igniter charge. The igniter charge and the bursting charge are situated behind the smoke composition in the training head, for igniting the smoke composition, in a capsule which can be forced rearwardly from the training head due to the increased pressure caused by combustion of the smoke composition, whereby an aperture is formed for passage of smoke gases rearwardly in the rocket, through the rocket tube and out of it.

6 Claims, 1 Drawing Sheet

TRAINING ROCKET FOR SMOKE DEVELOPMENT

BACKGROUND OF THE INVENTION

1. Field of the Invention

The present invention relates to a training rocket for smoke development, comprising a forward training head, which head contains a smoke composition and is adapted to emit visible smoke upon impact. Such rockets are used for practice firing, in order to mark the point of impact, whereby the point can be observed by the gunner from the firing site. The training head is mounted foremost on a rocket tube which contains propellant powder and constitutes a propulsive motor.

2. Description of the Related Art

Such rockets are known, which have a nose fuse and which give off the smoke forwardly upon impact, in that the fuse creates a hole in the nose head and ignites the smoke composition. Such a rocket is expensive to manufacture, and a drawback is that if the rocket hits for instance deep snow or another mass and penetrates into it, the development of smoke may terminate.

SUMMARY OF THE INVENTION

The present invention relates to a rocket having a training head and being based on the use of an igniter charge, such as a tracer charge, which is ignited by the propellant powder, and a bursting charge, such as a self-destruction member, which is ignited by the tracer charge. The igniter charge and the bursting charge are situated in the foremost of the powder chamber in the rocket tube, behind the smoke composition in the training head. The igniter charge is ignited by the powder gases during firing or while the rocket is in its trajectory. The igniter charge is slow-burning, and causes a delayed ignition of the bursting charge, which is situated between the igniter charge and the smoke composition situated in a closed chamber in the head. The bursting charge ignites the smoke composition, whereby the pressure in the smoke composition chamber increases. The igniter charge and the bursting charge are situated in a capsule which is relatively loosely attached in the head, for instance by means of weak threads, and the pressure in the chamber forces the capsule rearwardly, whereby it will be lying freely in the rocket tube, which of course is open rearwardly for outflow of the driving gases. At the impact the rocket tube is mainly emptied of driving powder, which has burnt through in the trajectory of the rocket. Thereby an aperture is formed through the rocket for outflow of the smoke gases rearwardly, through the rocket tube.

The rocket according to the invention is inexpensive to manufacture, compared with a rocket having an impact fuse, which, in the present invention, has been replaced by an igniter charge which is ignited by the smoke gases, and a bursting charge. The igniter charge can be a conventional tracer charge, and the bursting charge can be a conventional self-destruction charge. A free aperture for outflow of smoke gases from the smoke composition will be present even if the forward portion of the rocket has penetrated into the substratum upon impact, permitting the outflow of the smoke composition out of the rocket.

The tracer charge further causes a suitable delay of the ignition of the smoke composition. The delay may be adapted to the range of the rocket, whereby the smoke composition may be not be ignited until impact, if one so desires.

BRIEF DESCRIPTION OF THE DRAWINGS

An example of an embodiment of a rocket according to the invention will be explained in the following, with reference to the accompanying drawing.

DESCRIPTION OF A PREFERRED EMBODIMENT

Figure 1:
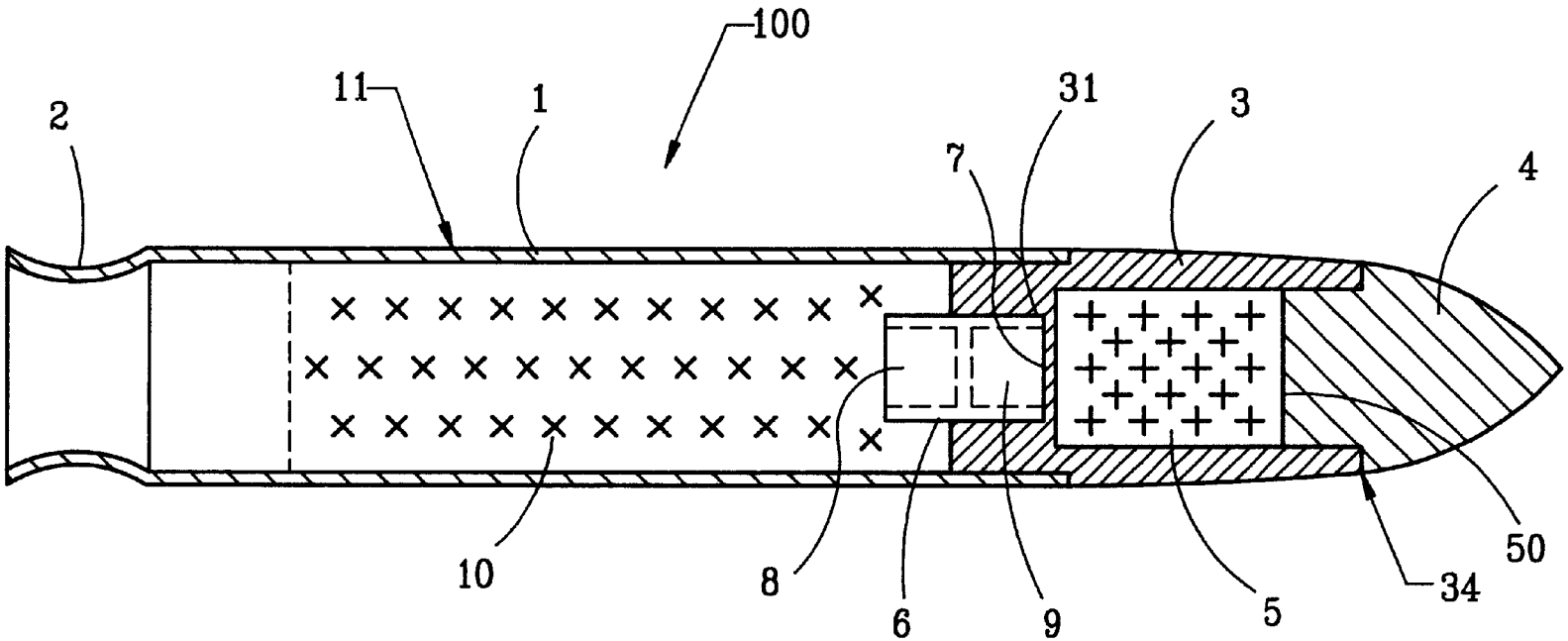
FIG. 1 is a sectional view taken along a longitudinal length of the inventive motor.

The designations "tracer charge" and "self-destruction charge" are used here, but these charges may be replaced by similar charges which do not necessarily have to be conventional tracer or self-destruction charges. It has, however, been found appropriate to use such charges, which are well suited for the purpose.

FIG. 1 shows a longitudinal section through a diagrammatically illustrated rocket 100 according to the invention. The rocket 100 comprises a rocket tube 1, having a nozzle portion 2 at a rearward end. The rocket tube contains propellant powder prior to the firing, which constitutes a propulsion motor for propelling the rocket. At the forward end of the rocket tube 1 is mounted a training head 34 comprising a socket 3 and a nose plug 4. All of these components may conveniently be made of metal. The socket 3 may for instance be screwed into the rocket tube 1 at the front of the rocket tube 1, and the plug 4 may be screwed into the socket 3 at the front of the socket 3 (threads are not shown in the Figure). A chamber 50 in the socket 3 contains a smoke composition 5. The tracer or igniter charge 8 and the self-destruction or bursting charge 9 are situated in a common capsule 6, which is relatively loosely attached in a bore 31 in the socket 3, for instance by means of threads which merely withstand a limited axial force, or in a loose interference fit, by glueing or in another similar manner.

In the embodiment shown, the smoke composition chamber 50 is closed at the rear by a thin wall 7. The self-destruction or bursting charge 9 is able to break the wall 7 that separates the capsule 6 and the smoke composition 5, and ignites the smoke composition 5.

Thus, the operation of the rocket is that the propellant powder 10 in the rocket tube 1 is ignited in a weapon in a known manner and propels the rocket 100 by the combustion of the propellant powder. During the last phase of the combustion, the tracer charge 8 in the capsule 6 is ignited and, after a certain combustion time, for instance 10-15 seconds, acts as an igniter charge for the self-destruction charge 9 in the capsule 6. At this point of time the propellant powder has been burnt through, and the rocket tube 1 is empty. The self-destruction charge 9 breaks the wall 7 and ignites the smoke composition 5, thereby, an increase of pressure takes place in the smoke composition chamber 50, causing the capsule 6 to be forced rearwardly, out of the bore 31 in the socket 3 and into the rocket tube 1. A free passage rearwardly in the rocket is thus formed for the smoke gases which are developed during the combustion of the smoke composition 5, and the smoke flows through the rocket tube I and exits out of the rearward end of the rocket, via the nozzle portion 2. This takes place without any hindrance even if the rocket 100 has penetrated into snow or another mass.

The present invention is by no means restricted to the above-described preferred embodiment, but covers all variations that might be implemented by using equivalent functional elements or devices that would be apparent to a person skilled in the art, or modifications that fall within the spirit and scope of the appended claims.

What is claimed is:

1. A training rocket for producing smoke, the rocket comprising:

a propulsion motor comprising a rocket tube filled with propellant powder;

a training head attached to a forward end of the propulsion motor, the training head comprising a smoke composition which is adapted to emit visible smoke upon activation; and a capsule detachably secured to a rearward end of the training head, the capsule comprising front and rear end portions, the front end portion of the capsule attached to the training head, the capsule further comprising an igniter charge and a bursting charge, the igniter charge positioned at the rear end portion of the capsule, such that when the rocket is fired, the igniter charge is activated by the propellant powder, whereby the igniter charge, after a time delay, activates the bursting charge which then ignites the smoke composition, and the capsule is forced rearwardly into the rocket tube due to increased pressure caused by combustion of the smoke composition, thereby permitting smoke generated by the smoke composition to be released out of the propulsion motor.

2. The training rocket according to claim 1, wherein the igniter charge is a conventional tracer charge.

3. The training rocket according to claim 1, wherein the bursting charge is a conventional self-destruction charge.

4. The training rocket according to claim 1, further comprising a socket having a smoke composition chamber, the smoke composition chamber is rearwardly closed by a wall that separates the capsule and the smoke composition which the bursting charge breaks, and which in the front is closed by a nose plug.

5. The training rocket according to claim 2, wherein the bursting charge is a conventional self-destruction charge.

6. The training rocket according to claim 1, further comprising a wall separating the bursting charge from the smoke composition.

* * * * *